US007857168B2

(12) United States Patent
Horstman et al.

(10) Patent No.: US 7,857,168 B2
(45) Date of Patent: Dec. 28, 2010

(54) CONTAINER WITH AN INTEGRATED SPOUT

(75) Inventors: Richard Lawrence Horstman, Cincinnati, OH (US); Douglas Bruce Zeik, Middletown, OH (US); Michael Anthony Majher, Cincinnati, OH (US); Alejandro Cedeno, Cincinnati, OH (US); Constance P. Lee, Cincinnati, OH (US); Brian Lee Floyd, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/613,050

(22) Filed: Nov. 5, 2009

(65) Prior Publication Data

US 2010/0108635 A1 May 6, 2010

Related U.S. Application Data

(60) Provisional application No. 61/198,462, filed on Nov. 6, 2008.

(51) Int. Cl.
*B67D 1/16* (2006.01)

(52) U.S. Cl. ..... 222/109; 222/566; 264/531

(58) Field of Classification Search ..... 222/556–571, 222/108–111; 264/531–534; 215/41; 220/717, 220/719

See application file for complete search history.

(56) References Cited

U.S. PATENT DOCUMENTS

| | | | | |
|---|---|---|---|---|
| 4,367,821 | A * | 1/1983 | Holt | 220/659 |
| 4,550,862 | A * | 11/1985 | Barker et al. | 222/109 |
| 4,640,855 | A | 2/1987 | St. Clair | |
| 4,696,416 | A * | 9/1987 | Muckenfuhs et al. | 222/109 |
| 4,890,770 | A * | 1/1990 | Haga et al. | 222/109 |
| 4,989,757 | A * | 2/1991 | Krall | 222/111 |
| 5,020,692 | A * | 6/1991 | Darr | 222/109 |
| 5,114,659 | A * | 5/1992 | Krall | 264/539 |
| 6,413,467 | B1 * | 7/2002 | Britton | 264/537 |
| 6,500,380 | B1 * | 12/2002 | Geisinger | 264/539 |
| 7,153,127 | B2 * | 12/2006 | Struble et al. | 425/525 |
| 2008/0283552 | A1 * | 11/2008 | Penny | 222/109 |
| 2009/0220717 | A1 | 9/2009 | Wilczak et al. | |
| 2009/0220809 | A1 | 9/2009 | Bertheol et al. | |

FOREIGN PATENT DOCUMENTS

| | | | |
|---|---|---|---|
| EP | 0 329 883 | A1 | 8/1989 |
| EP | 0 378 047 | A1 | 7/1990 |
| GB | 678 883 | A | 9/1952 |

OTHER PUBLICATIONS

PCT International Search Report dated Mar. 2, 2010—14 pgs.

* cited by examiner

*Primary Examiner*—Lien T Ngo
(74) *Attorney, Agent, or Firm*—David V. Upite; Gary J. Foose

(57) ABSTRACT

A bottle comprising a body capable of containing a fluid; a spout fluidly connected to the body; a collar comprising at least one attachment area, said collar capable of removably securing a cap; a skirt functionally connected to the collar; and a drip concentrator concentrically interposed between the spout and the collar; wherein the bottle is continuous. In one embodiment, the skirt visually engages with the body.

8 Claims, 7 Drawing Sheets

CONTAINER WITH AN INTEGRATED SPOUT

CROSS REFERENCE TO RELATED APPLICATION

This application claims priority to U.S. Provisional Application Ser. No. 61/198,462, filed Nov. 6, 2008.

FIELD OF THE INVENTION

This invention relates to the field of containers and their methods of manufacture. This invention further relates to one-piece containers with multiple design elements.

BACKGROUND OF THE INVENTION

Bottles for storing and dispensing liquids are known in the art. Many bottle types exist, being made of different materials and configurations. The mechanisms by which bottles store and dispense fluids have become more and more complex as the end user expects additional benefits. These benefits include repeatably removable caps, spouts, caps functioning as dosing cups, drainback features, and the like. These items have resulted in more complexity in the bottle. In turn, these additional complexities result in an increasing complex manufacturing process. These complexities require bottles having multiple parts, including mechanisms for attaching a cap, glue rings, elements for force fitments, and the like. These items must be put together in what is often a multistep process, adding additional cost and complexity.

Blow-molded polyethylene phthalate ("PET") bottles are also known in the art. PET bottles have been used multiple industries because of their ease of manufacture, low resin costs, and recyclability. While the technology for producing fairly simple PET structures is known, the addition of additional elements has been difficult. Specifically, adding elements such as a spout or drainback feature within the structure of a PET bottle has been possible with available technologies.

What is needed is a bottle capable of delivering various benefits with little or no additional manufacturing complexities. The current invention delivers these objectives.

US 2009/0220809; US 2009/0220717; US 2008/0283552; U.S. Pat. No. 5,114,659; U.S. Pat. No. 4,640,855; U.S. Pat. No. 4,550,862.

SUMMARY OF THE INVENTION

In one embodiment there is a bottle comprising a body capable of containing a fluid; a spout fluidly connected to the body; a collar comprising at least one attachment area, said collar capable of removably securing a cap; a skirt functionally connected to the collar; and a drip concentrator concentrically interposed between the spout and the collar; wherein the bottle is continuous. In one embodiment, the skirt visually engages with the body.

In an alternate embodiment, there is a preform comprising a tubular body capable of being molded; a spout fluidly connected to the tubular body; a collar comprising at least one attachment area, said collar capable of removably securing a cap; a skirt functionally connected to the collar; and a drip collector concentrically interposed between the spout and the collar; wherein the preform is continuous.

DETAILED DESCRIPTION OF THE INVENTION

Figure 1:
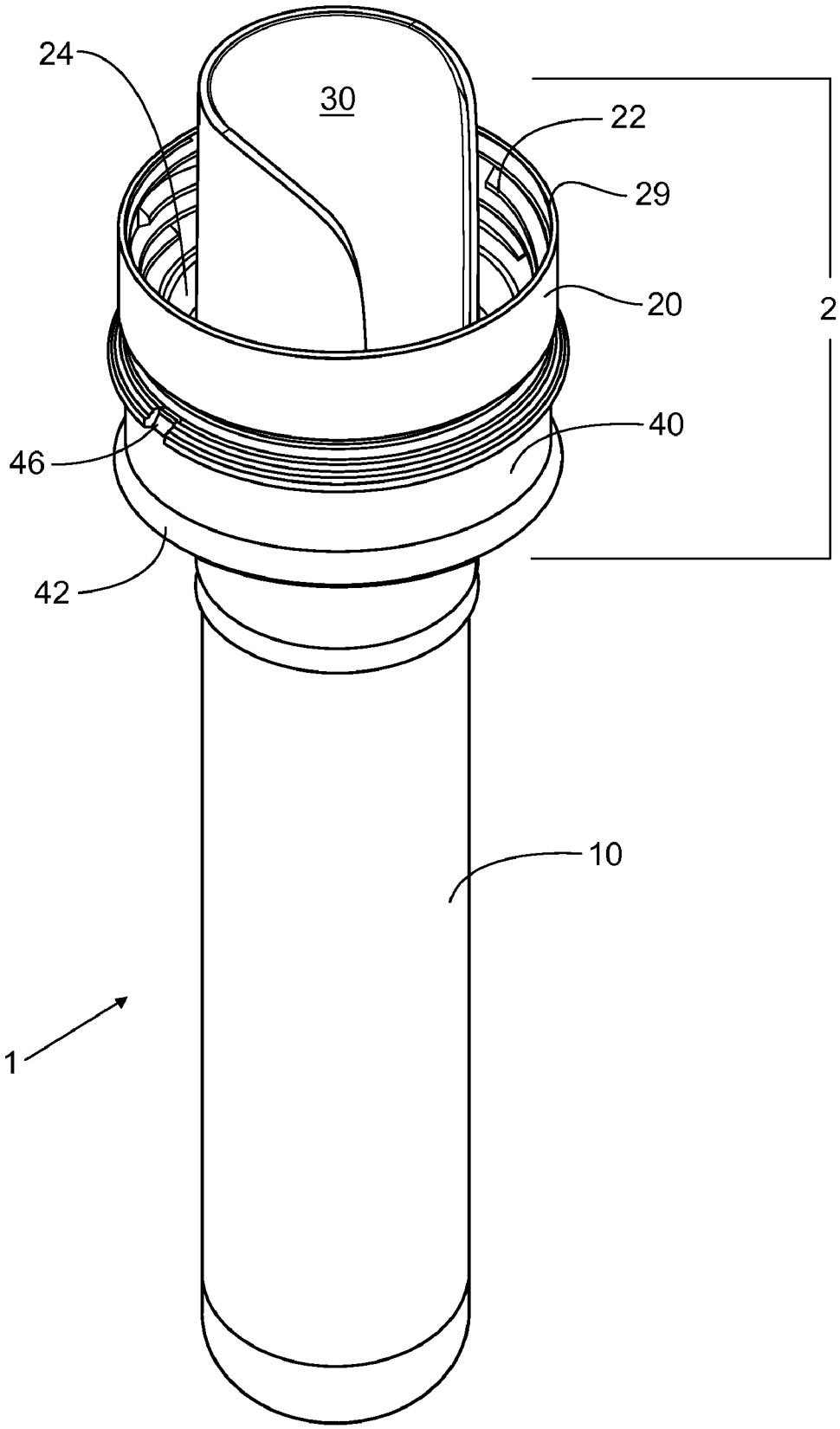
FIG. 1 is a perspective view of a first embodiment of the preform.

The term "one piece" or "continuous" as used herein, means that the preform or the bottle is made of one continuous piece of material, without the need for joining by welding, adhesive, heat seals, mechanical means, or other processes. The term "multi piece" as used herein, means that the preform or the bottle is made of more than one piece of material.

The term "substantially" as used herein, means a dimensional change of less than about 5%. For example, two objects having substantially the same volume would have actual volumes differences of less than about 5%.

The term "vent" as used herein, means an opening in the drip concentrator capable of allowing a fluid to pass through. The vent can be fully surrounded by the drip concentrator, e.g., a hole or circular shape within the drip concentrator. The vent can also be partially surrounded by the drip concentrator, e.g., a notch or cutout. Alternatively, the fluid pathway from the spout to the body of the bottle may be considered the vent.

The term "visually engage" as used herein, means for a structure to contact or to nearly contact (less than about 5 mm, alternatively less than about 2 mm) a second structure whereby the two structures have the appearance of being sealed, closed, or otherwise engaged with each other without additional processing steps including welding, adhesives, heat seals, mechanical means, and the like.

The term "fluid" as used herein, means any substance that is capable of being poured. Fluids of the present invention include both liquids, fluidizable solids or powders, and granular compositions that are capable of being poured.

It has been found that a bottle comprising is a bottle comprising a body capable of containing a fluid; a spout fluidly connected to the body; a collar comprising at least one attachment area, said collar capable of removably securing a cap; a skirt functionally connected to the collar; and a drip concentrator concentrically interposed between the spout and the collar; wherein the bottle is continuous provides the benefit of an inexpensive bottle that is constructed with fewer steps in fewer pieces.

Without wishing to be bound by theory, it is believed that the bottle of the present invention allows for a bottle containing various elements, including a drip collector, spout, skirt, collar, and the like to be constructed as a one piece bottle with reduced processing and assembly. Moreover, various elements may be added or removed depending on the desired end function of the bottle, allowing for custom application bottles. Spout shape can be non round (v shape or elliptical) and may not need to be a complete circle.

It is contemplated that the process for moving from the preform to bottle utilizes blow molding techniques, such as stretch blow molding. Such techniques are well known in the art. While these techniques are well known, utilizing blow molding to produce the bottle of this invention is unique, as having a bottle with the elements disclosed herein has before been unattainable.

Various plastics materials are suitable, including polyvinyl chloride, high and low density polyethylene, polypropylene, acrylic, polystyrene, or polycarbonate. Since the one-piece construction offers savings, more expensive materials such as polyethylene terepthalate (PET), polyethylene napthalate (PEN) and copolymers and blends of these two materials in both crystalline and amorphous forms are viable.

Figure 2:
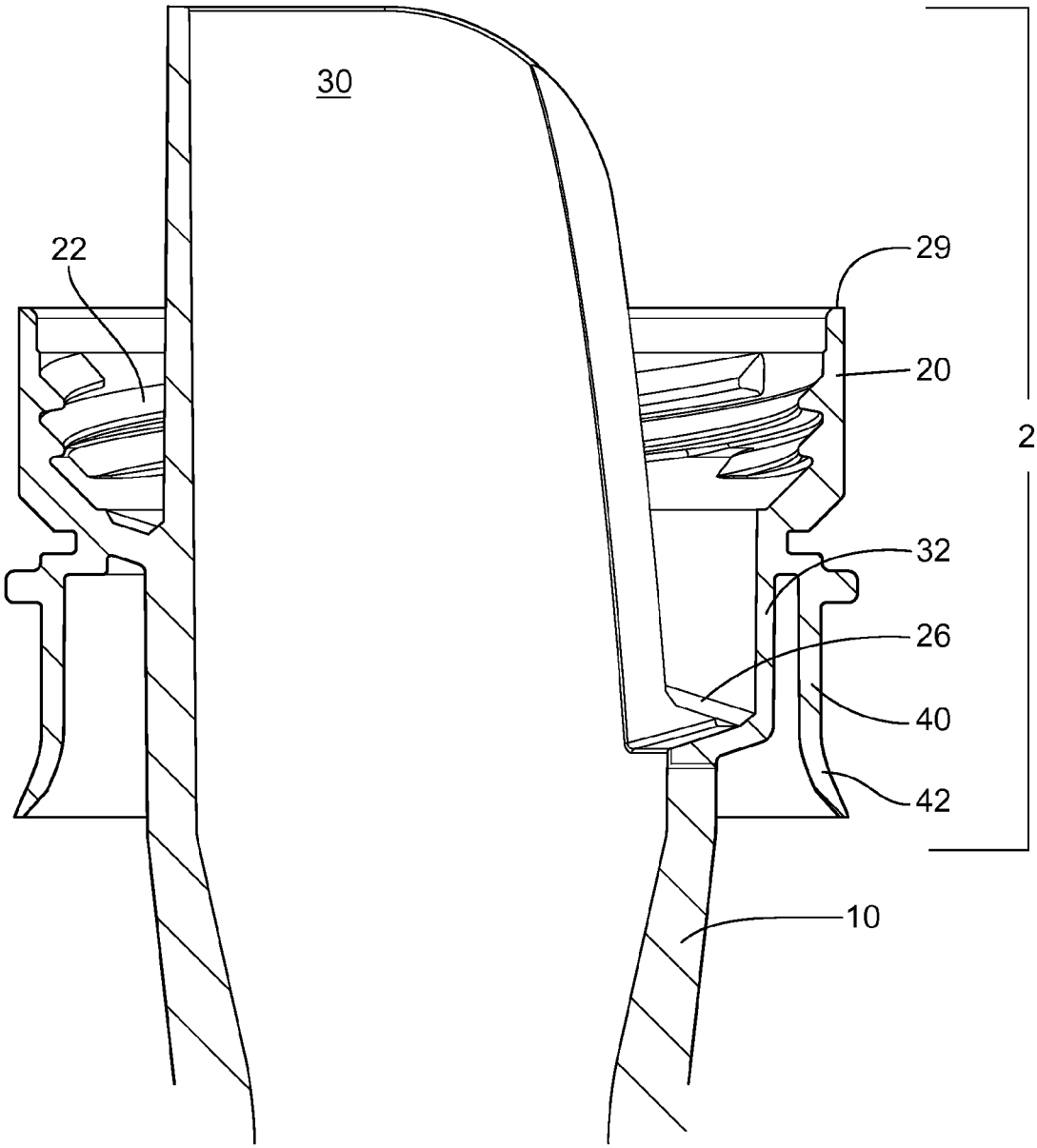
FIG. 2 is a front sectional view of the preform of FIG. 1, with a transparent side for exposing internal features.

In one embodiment, the resin of the present invention is manipulated to form a preform. An exemplary preform of the present invention is illustrated in FIGS. 1 and 2. Any method of forming and or molding the preform can be utilized. In one embodiment, the preform is formed by injection molding, as exemplified in U.S. Pat. No. 6,123,231, the entirety of which is incorporated by reference. The preform of this invention is capable of being formed into a bottle or container.

In one embodiment, the preform is made from one piece. Such a one piece preform has the advantages of incorporating various elements without additional manufacturing or processing steps. The mold for a one piece preform is such that a desired preform can be made by injecting resin into the preform mold in one processing step. Such a preform, when made into a bottle or container forms a continuous or one piece bottle.

In FIGS. 1 and 2, the preform 1 has a tubular body 10 that is functionally connected to the head 2. During the blow molding process, the tubular body 10 expands into mold, forming the final shape of the resulting bottle. In one embodiment, the shape of the head 2 remains substantially unchanged during the blow molding process. Such a configuration allows for precise molding of objects in the head 2 that are not altered significantly by later blow molding processes.

The head 2 of the illustrated preform 1 contains a spout 30, collar 20, skirt 40, and a drip concentrator 24. The tubular body 10 is fluidly connected to the spout 30. In one embodiment, the spout 30 and tubular body 10 are oriented to allow the insertion of a blow pin used during a blow molding process. The spout 30 functions to direct the liquid out of the fully blown bottle. Typically, the spout extends in length beyond the collar 20 to prevent buildup of product inside of the head 2. The spout 30 extending beyond the collar 20 allows pouring of contained product into a dispensing cup.

The drip concentrator 24 is concentrically interposed between the spout 30 and the collar 20. The drip concentrator 24 functions to gather any product remaining in the closure (e.g., dispensing cup) upon reapplication of the closure. The drip concentrator 24 further contains a vent 26. The vent 26 allows any product captured by the drip concentrator 24 to be collected within the blown bottle. In one embodiment, the drip collector is oriented in a non-parallel orientation to the rim 29. Without wishing to be bound by theory, it is believed that this non-parallel orientation of the drip concentrator 24 facilitates fluid transport of the material on the drip concentrator 24 through the vent 26 into the blown bottle.

The collar 20 is functionally attached to the drip concentrator 24. The collar further comprises an attachment area for engaging a cap, lid, top, or other sealing mechanism. An attachment area of the current invention includes threads 22. Threads 22 are present on the inside of the collar 20. The threads 22 are designed to engage with a cap for sealing the contents of the blown bottle. While threads 22 are illustrated here, other engagement mechanisms are also contemplated. Such engagement mechanisms would be readily known by one of skill in the art. For example, the orientations of threads 22 on the collar 20 can also be placed on the outside of the collar 20, instead of the internal position illustrated.

In one embodiment the rim 29 of the collar 20 serves at least one sealing function. When blow molding the preform into a bottle, the rim 29 at least partially engages with the blow pin forming a seal, facilitating blow molding. Upon completion of the blow molding, the collar 20, when engaged with a cap forms at least a partial seal with the rim 29 when engaged. The skirt 40 is functionally connected to the collar 20. The skirt 40 optionally comprises a flute 42 on an end of the skirt 40. The flute 42 may be curved, angled, straight, or shaped otherwise to allow for visual engagement of the skirt 40 with the body 10 after the blow molding step.

Figure 3:
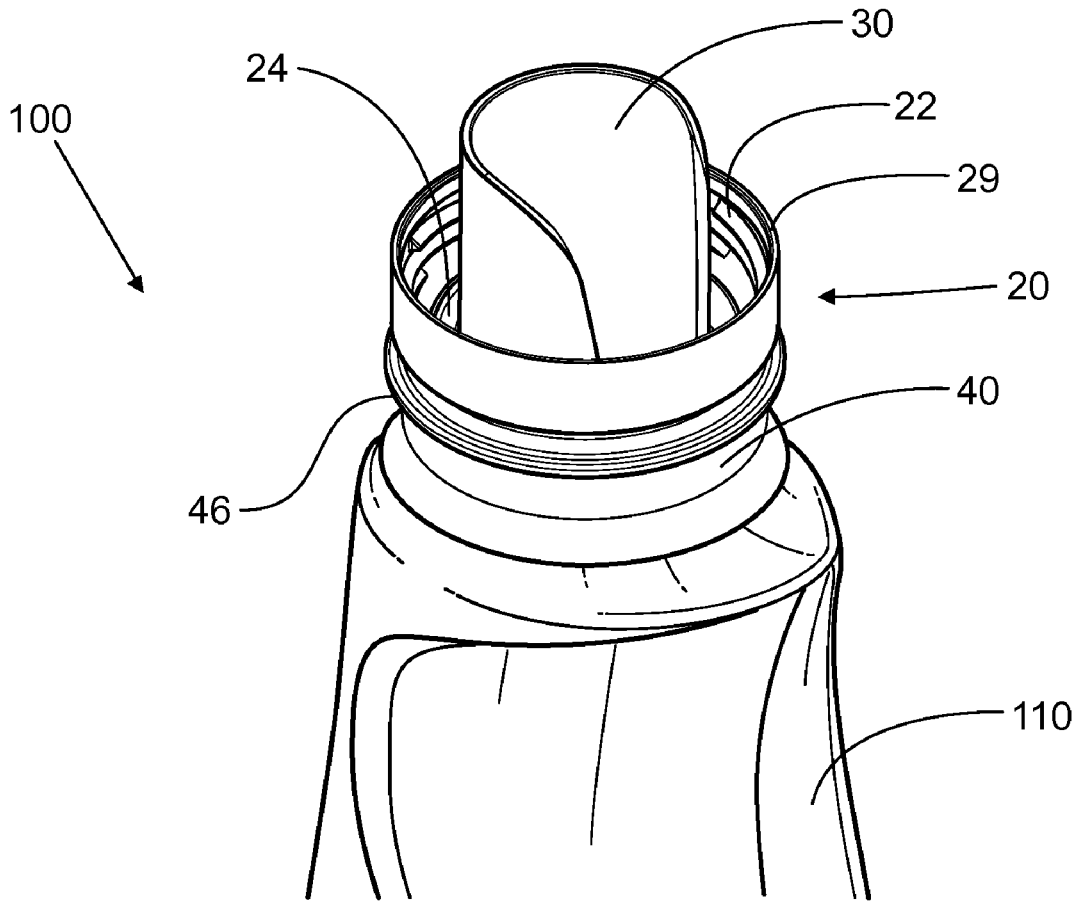
FIG. 3 is a perspective view of the bottle molded from the preform of FIGS. 1 and 2.
Figure 4:
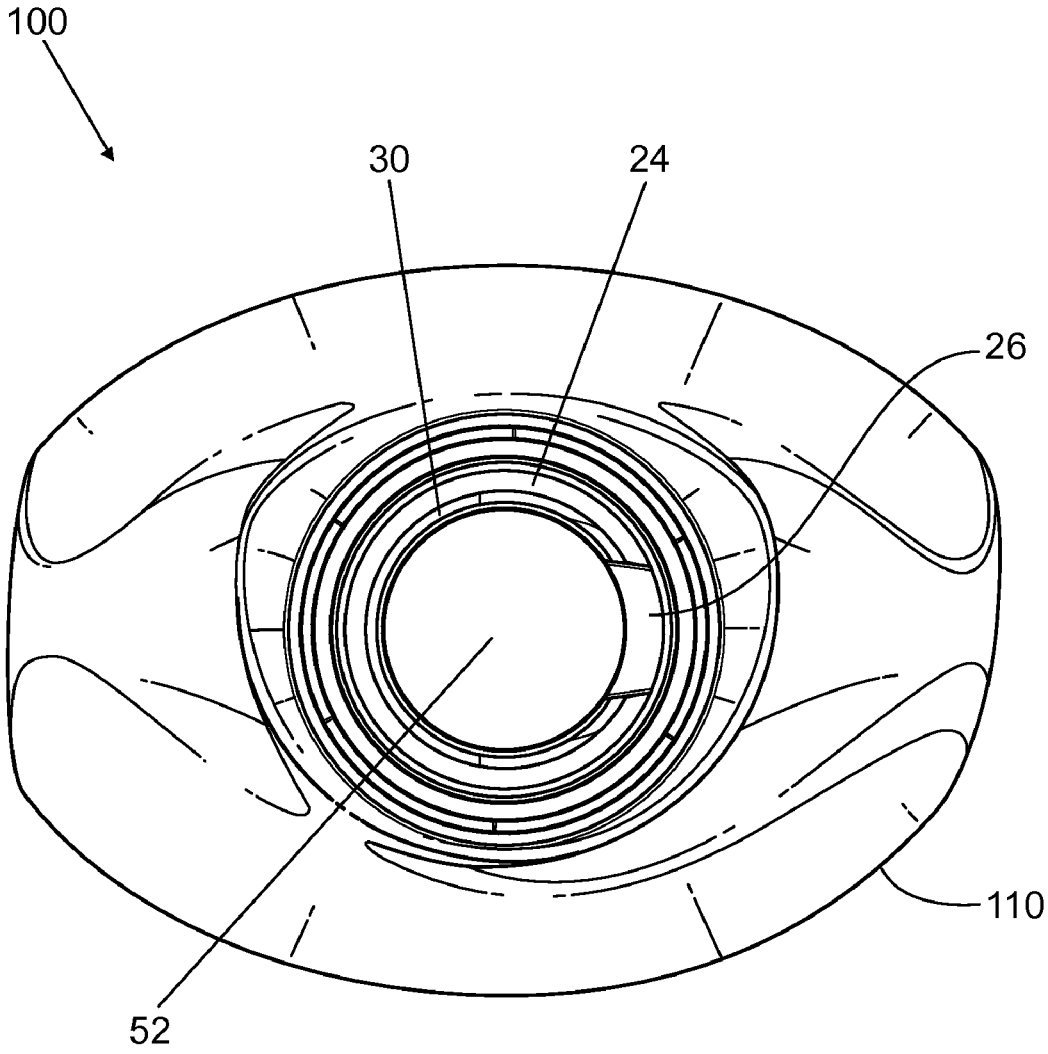
FIG. 4 is a top view of the bottle molded of FIG. 3.

FIGS. 3 and 4 illustrate a bottle 100 after the blow molding step of the preform 1. The tubular body 10 (FIG. 1, FIG. 2) expands into the blow mold to form the body 110 of the bottle 100. While blow molding is expected to be the preferred method of expansion, aided by mechanical stretching for large containers, it is possible to achieve the same effect by suction molding.

In one embodiment, the skirt 40 visually engages the body 110, as further exemplified in FIGS. 3 and 4. In one embodiment, the skirt 40 is functionally connected to the collar 20. In an alternate embodiment, the skirt 40 is connected to the drip concentrator 24. Without wishing to be bound by theory, the skirt 40 provides a way to hide the internals of the drip concentrator 24, vent 26 and/or other parts of the head 2 and/or bottle 100. The skirt 40 provides a clamping region for the blow mold during the blow molding process. The skirt 40 also functions to hide residue that builds up on the portions of the bottle 100 located behind the skirt 40. The skirt 40 also visually extends the smoother surface of the body 110, allowing for additional labeling and producing a more desirable tactile experience. The skirt protects the drain-back feature from distortion during the blowing process (during heating and helps placement in the mold). The skirt can also be used as a feature to aid with orientation of the spout. The skirt can also be useful in aesthetics providing an opportunity for bottle design and/or cover the drain back feature from a consumer's view.

In an alternate embodiment, not illustrated, the skirt can be molded separately and introduced onto the bottle, forming a multi-piece bottle. In such an embodiment, the skirt and body are made of the same material or optionally different materials.

As the preform of the present invention contains many different elements, proper orientation of these elements is desired when blow molding the preform into the bottle. Such a feature is of particular importance when the body 110 is not cylindrical, but has a length longer than its width. Proper orientation of the preform in the blow mold can be achieved utilizing an optional orientation notch 46, illustrated on the preform. Such an orientation notch 46 is capable of aligning with machinery capable of processing the preform 1, such as blow molding machines, conveyers, and the like.

Figure 5:
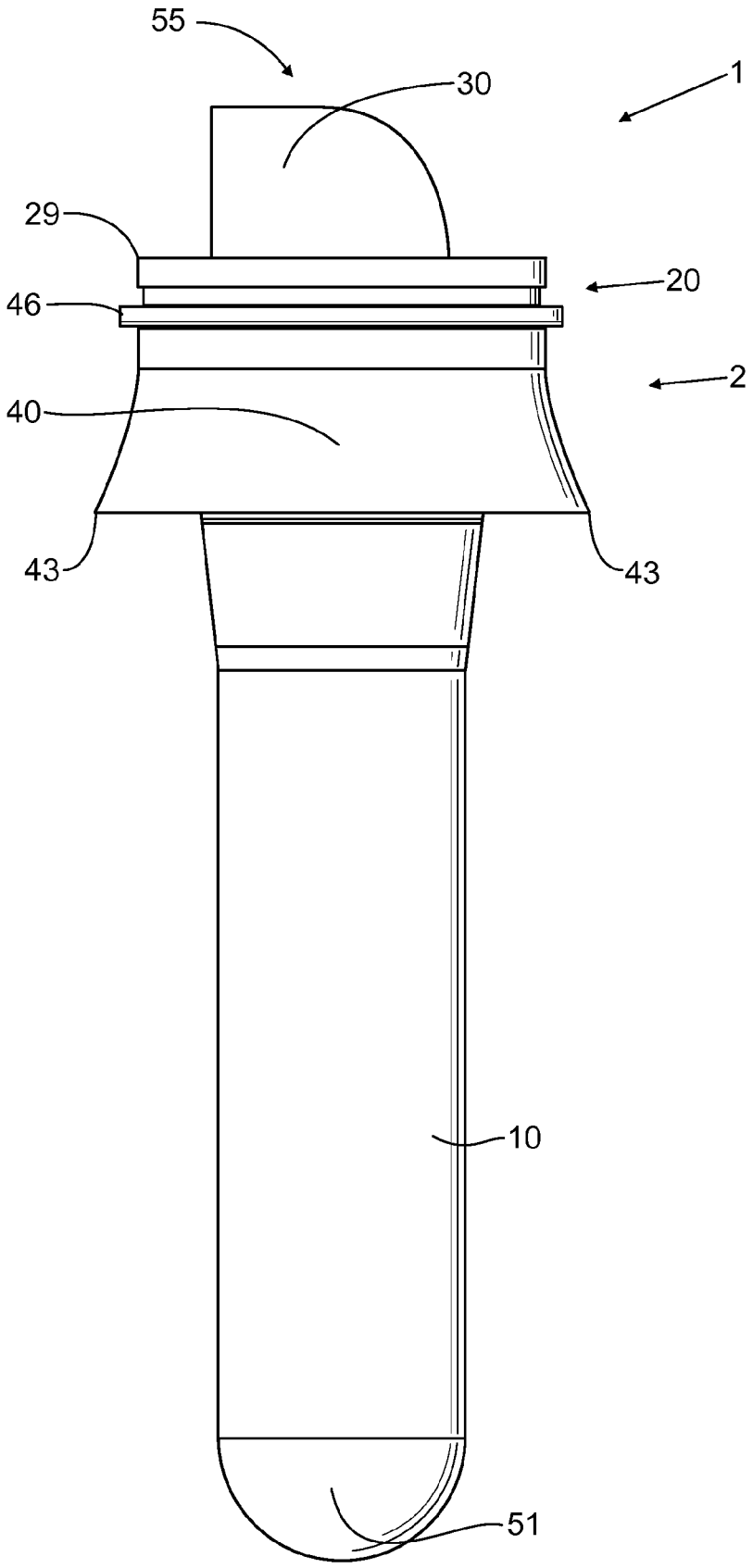
FIG. 5 is a front view of a second embodiment of the preform
Figure 6:
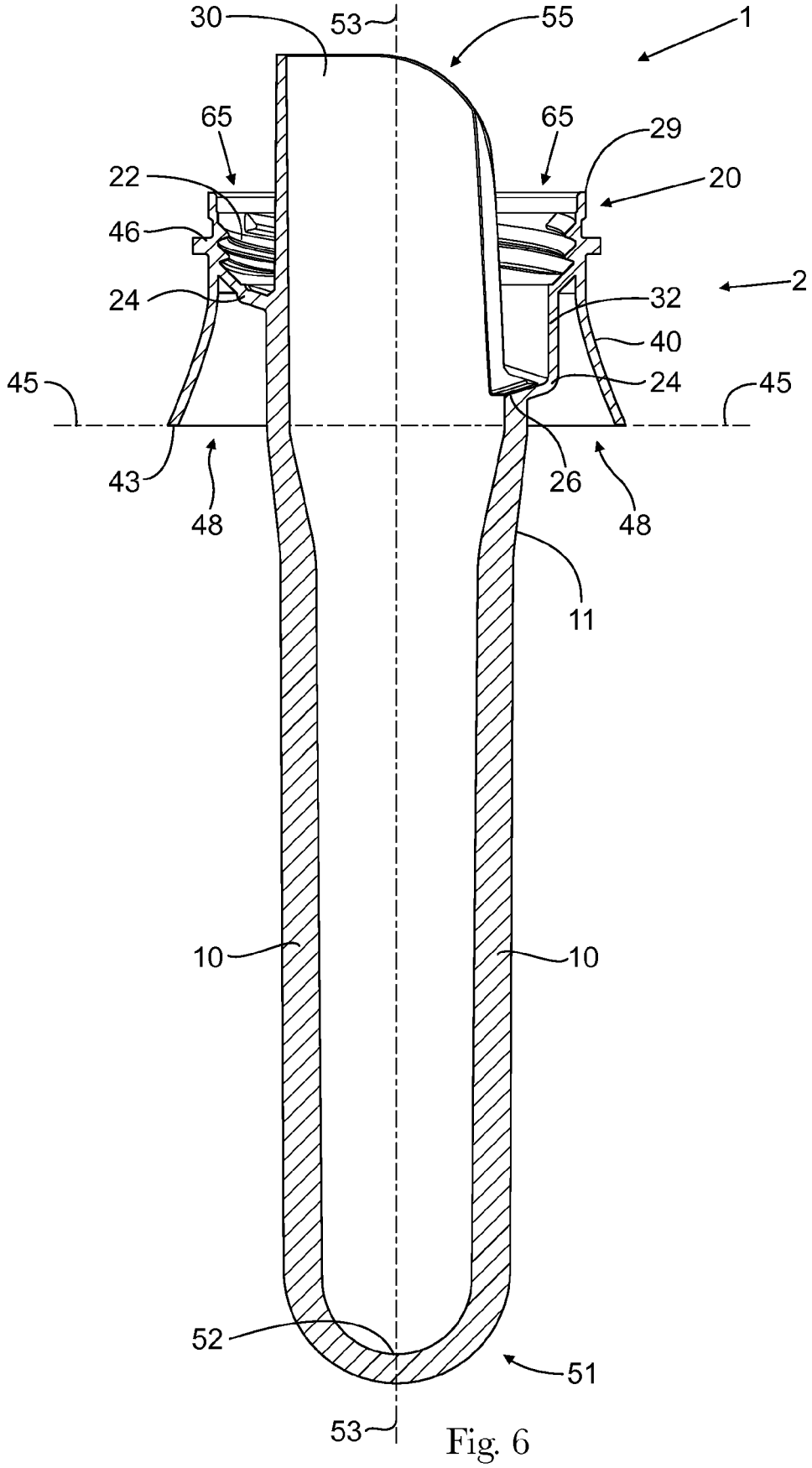
FIG. 6 is a cross sectional front view of the preform of FIG. 5.
Figure 7:
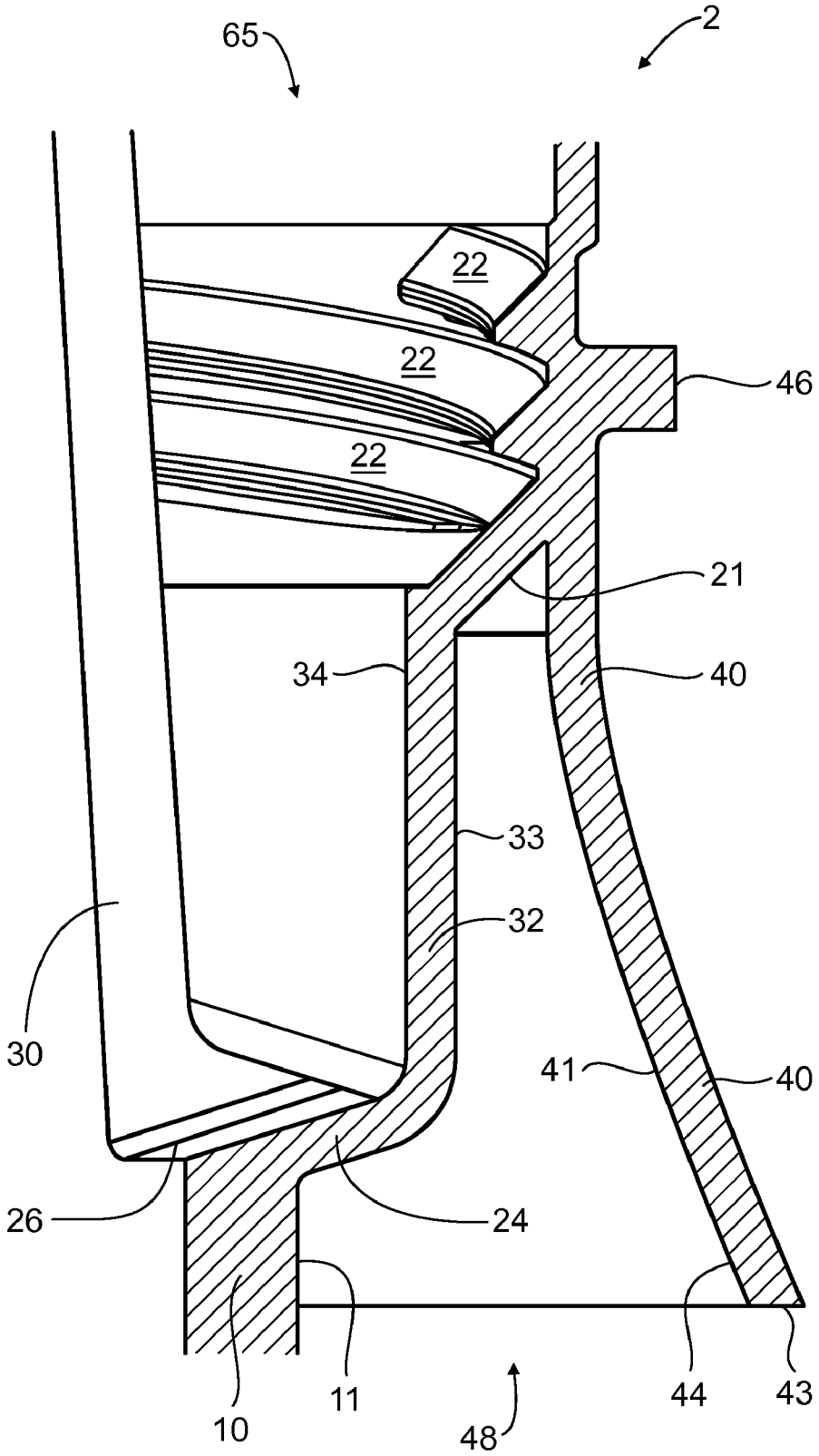
FIG. 7 is an expanded cross sectional front view of a portion of the preform of FIGS. 5 and 6.

FIGS. 5 and 6 are front and cross sectional front views of a second embodiment of a preform 1. FIG. 7 is an expanded view of the cross section of FIG. 6. The preform (1) comprising a tubular body (10) capable of being molded; a spout (30) fluidly connected to the tubular body (10); a collar (20) comprising at least one attachment area, said collar (20) capable of removably securing a cap; a skirt (40) functionally connected to the collar (20); and a drip concentrator (24) concentrically interposed between the spout (30) and the collar (20); wherein the preform (1) is continuous.

As illustrated in FIG. 6, the preform (1) has a longitudinal center axial plane (53). The preform (1) has a base (1). The base (1) has a center point of base (52). The longitudinal center axial plane (53) passes from the center point base of base (52), through the axial (i.e., vertical) radial center of the preform (1) (or bottle (100)), and through spout opening (55).

The skirt (4) has a circumferential edge of skirt (43). A circumferential edge of skirt plane (45) passes through the circumferential edge of skirt (43), and wherein the circumferential edge of skirt plane (45) is orthogonal with respect to the longitudinal center axial plane (53). The circumferential edge of skirt (44) is concentric and may comprises a diameter from 30 mm to 90 mm, alternatively from 40 mm to 80 mm, alternatively from 50 mm to 70 mm, alternatively from 40 mm to 60 mm, alternatively from 50 mm to 60 mm, alternatively from 54 mm to 60 mm, alternatively 57 mm, alternatively combinations thereof, measured along the circumferential edge of skirt plane (45). The skirt dimensions may equally apply to the bottle (100). In other embodiments (not show in the figures), the circumferential edge of skirt may be concentric but the respective circumferential edge of skirt plane need not be orthogonal with respect to the longitudinal center axial plane, but rather angled. This angle may be from to 91 degrees to 151 degrees, alternatively 95 degrees to 145 degrees, alternatively 100 degrees to 125 degrees, alternatively combinations thereof, with respect to the longitudinal axial plane. In another embodiment, the angle of the circumferential edge of skirt plane is the same as the angle of the drip concentrator (with respect to the longitudinal axial plane). In yet other embodiments, the skirt need not be concentric but rather a variety of shapes and sizes (i.e., non-concentric). In yet still other embodiments, only one portion (alternatively 2, 3, 4, or more portions) of the circumferential edge of skirt may be orthogonal with respect to the longitudinal axial plane. Similarly only one portion (alternatively 2, 3, 4, or more portions) of the circumferential edge of skirt is orthogonal with respect to the longitudinal axial plane.

Referencing FIG. 7, the skirt (40) comprises a circumferential edge of skirt (43), wherein at least a portion of the circumferential edge of skirt (43) extends longitudinally (i.e., parallel to the longitudinal center axial plane) beyond the drip concentrator (24) by 1 mm or greater. Alternatively the circumferential edge of skirt (43) extends longitudinally (i.e., parallel to the longitudinal center axial plane) beyond the drip concentrator (24) from 1 mm to 50 mm, alternatively 2 mm to 40 mm, alternatively from 3 mm to 30 mm, alternatively from 4 mm to 20 mm, alternatively from 1 mm to 10 mm, alternatively combinations thereof.

In FIGS. 6 and 7, the preform (1) may comprise a skirt cavity (48) having a skirt annular volume. The preform (1) may further comprising an inner wall (32) fluidly connected between the collar (20) and the drip concentrator (24), wherein the drip concentrator (24) is also concentrically interposed between the spout (30) and the inner wall (32). As detailed in FIG. 7, the skirt cavity (48) is defined by an inside surface of skirt (41), skirt facing surface of inner wall (33), skirt facing surface of inner wall (33), skirt facing surface of collar (21), wherein the skirt annular volume comprises from about 2 $cm^3$ to about 70 $cm^3$, alternatively 3 $cm^3$ to 60 $cm^3$, alternatively 4 $cm^3$ to 50 $cm^3$, alternatively 5 $cm^3$ to 40 $cm^3$, alternatively 6 $cm^3$ to 30 $cm^3$, alternatively 7 $cm^3$ to 20 $cm^3$, alternatively 8 $cm^3$ to 15 $cm^3$, alternatively 1 $cm^3$ to 20 $cm^3$, alternatively combinations thereof.

In FIG. 7, the circumferential edge of skirt (41) comprises an inner surface of circumferential edge of skirt (44), wherein at least a portion of the inner surface of circumferential edge of skirt (44) is at least 1 mm (alternatively 1 mm to about 70 mm, alternatively 3 mm to 60 mm, alternatively 4 mm to 50 mm, alternatively 5 mm to 40 mm, alternatively 6 mm to 30 mm, alternatively 7 mm to 20 mm, alternatively 8 mm to 15 mm, alternatively 1 mm to 20 mm) from the outer surface of tubular body (11) measured orthogonally respect to a longitudinal center axial plane (53). In one embodiment, entire portion of the inner surface of circumferential edge of skirt (44) is from 1 mm to 20 mm from the outer surface of tubular body (11) measured orthogonally respect to a longitudinal center axial plane (53). In alternative embodiment, at least one portion (alternatively 2, 3, 4 or more portions) is from 1 mm to 20 mm from the outer surface of tubular body (11) measured orthogonally respect to a longitudinal center axial plane (53).

In one embodiment, at least one portion (alternatively 2, 3, 4 or more portions) of the skirt comprises a thickness from 0.1 mm to 4 mm, alternatively from 0.2 to 3 mm, alternatively from 0.3 mm to 2 mm, alternatively from 0.4 mm to 1 mm, alternatively from 0.1 to 2 mm, alternatively combinations thereof.

Although not shown in the figures, another aspect of the invention provides a bottle having a longitudinal center axial plane, wherein the skirt further comprises a circumferential edge of skirt, and wherein at least a portion of the circumferential edge of skirt extends longitudinally (i.e., parallel to the longitudinal center axial plane) beyond the drip concentrator from 1 mm to 30 mm, alternatively from 1 mm to 50 mm, alternatively 2 mm to 40 mm, alternatively from 3 mm to 30 mm, alternatively from 4 mm to 20 mm, alternatively from 1 mm to 10 mm, alternatively combinations thereof. In one embodiment, the bottle has the entire circumferential edge of skirt that is orthogonal to the longitudinal center axial plane. In alternative embodiments, at least one portion of the circumferential edge of skirt is orthogonal to the longitudinal center axial plane. In yet other embodiments, not one portion of the circumferential edge of skirt is orthogonal to the longitudinal center axial plane.

In one embodiment, the bottle has a skirt (alternatively at least one or more portions) comprising a length (i.e., longest dimension) from 3 mm to 30 mm (alternatively from 1 mm to 50 mm, alternatively from 2 mm to 40 mm, alternatively from 3 mm to 30 mm, alternatively from 4 mm to 20 mm, alternatively from 5 mm to 10 mm, alternatively combinations thereof). The bottle may comprise a cap removable secured to the collar, wherein the cap comprises at least one dosing line; and wherein the bottle contains a fluid fabric care composition (e.g., TIDE or DOWNY) or a mouthwash composition (e.g. SCOPE). In another embodiment, the bottle has a longitudinal center axial plane, and wherein at least a first portion (alternatively 2, 3, 4 or more portions) of the circumferential edge of skirt is orthogonal to the longitudinal center axial plane, and wherein at least a second portion (alternatively 2, 3, 4, or more portions) of the circumferential edge of skirt is not orthogonal to the longitudinal center axial plane.

The preform and bottle of this invention can be used with any fluid composition. In one embodiment, the fluid composition is a fabric care composition (e.g., liquid laundry detergent, liquid fabric softener, etc.). Advantageously, the bottle is particularly suited for dispensing a fabric care composition.

In one embodiment, the skirt has opacity and/or texture to allow for better gripping by the consumer and/or hiding the drain back feature from the consumer (i.e., aesthetics).

The devices, apparatuses, methods, components, and/or compositions of the present invention can include, consist essentially of, or consist of, the components of the present invention as well as other ingredients described herein. As used herein, "consisting essentially of" means that the devices, apparatuses, methods, components, and/or compositions may include additional ingredients, but only if the additional ingredients do not materially alter the basic and novel characteristics of the claimed devices, apparatuses, methods, components, and/or compositions.

All percentages and ratios used herein are by weight of the total composition and all measurements made are at 25° C., unless otherwise designated. A degree is a planar unit of angular measure equal in magnitude to 1/360 of a complete revolution.

All measurements used herein are in metric units unless otherwise specified.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A preform (1) comprising a tubular body (10) capable of being molded;

a spout (30) fluidly connected to the tubular body (10);

a collar (20) comprising at least one attachment area, said collar (20) capable of removably securing a cap;

a skirt (40) functionally connected to the collar (20); and a drip concentrator (24) concentrically interposed between the spout (30) and the collar (20);

wherein the preform (1) is continuous;

wherein the skirt (40) comprises a circumferential edge of skirt (43);

wherein the circumferential edge of skirt (43) comprises an inner surface of circumferential edge of skirt (44), wherein at least a portion of the inner surface of circumferential edge of skirt (44) is at least 1 mm longitudinally beyond the outer surface of tubular body (11) measured orthogonally respect to a longitudinal center axial plane (53).

2. The preform (1) of claim 1, further comprising an inner wall (32) fluidly connected between the collar (20) and the drip concentrator (24), wherein the drip concentrator (24) is also concentrically interposed between the spout (30) and the inner wall (32).

3. The preform (1) of claim 1, wherein at least a portion of the circumferential edge of skirt (43) extends longitudinally beyond the drip concentrator (24) by 1 mm or greater.

4. The preform (1) of claim 2, wherein at least a portion of the circumferential edge of skirt (43) extends longitudinally beyond the drip concentrator (24) from 1 mm to 30 mm.

5. The preform (1) of claim 4, further comprising a skirt cavity (48) having a skirt annular volume, wherein the skirt cavity (48) is defined by an inside surface of skirt (41), skirt facing surface of inner wall (33), skirt facing surface of inner wall (33), skirt facing surface of collar (21), wherein the skirt annular volume comprises from about 2 $cm^3$ to about 50 $cm^3$.

6. The preform (1) of claim 1, wherein a circumferential edge of skirt plane (45) passes through the circumferential edge of skirt (43), and wherein the circumferential edge of skirt plane (45) is orthogonal with respect to the longitudinal center axial plane (53).

7. The preform (1) of claim 6, wherein the entire inner surface of circumferential edge of skirt (44) is from 1 mm to 20 mm longitudinally beyond the outer surface of tubular body (11) measured orthogonally respect to a longitudinal center axial plane (53).

8. The preform (1) of claim 7, wherein at least a portion of the skirt comprises a thickness of 0.1 mm to 2 mm; and wherein the circumferential edge of skirt (44) is concentric and comprises a diameter from 30 mm to 90 mm measured along the circumferential edge of skirt plane (45).

* * * * *